United States Patent [19]

Wallman et al.

[11] Patent Number: 5,052,517

[45] Date of Patent: Oct. 1, 1991

[54] FOLDING SAWHORSE

[75] Inventors: Randolph J. Wallman, Winnipeg; Lindsay T. Oliver, St. Norbert; Harvey Oliver, Winnipeg, all of Canada

[73] Assignee: CFH Corporation, Minot, N. Dak.

[21] Appl. No.: 599,739

[22] Filed: Oct. 19, 1990

Related U.S. Application Data

[63] Continuation-in-part of Ser. No. 466078, Jan. 16, 1990, Pat. No. 4,967,877.

[30] Foreign Application Priority Data

Jan. 5, 1990 [CA] Canada ..... 2007265

[51] Int. Cl.[5] ..... B27B 21/00; B25H 1/06

[52] U.S. Cl. ..... 182/155; 182/181; 182/225

[58] Field of Search ..... 182/155, 181–186, 182/225

[56] References Cited

U.S. PATENT DOCUMENTS

| | | | |
|---|---|---|---|
| 1,476,855 | 12/1923 | Topp | 182/155 |
| 2,174,952 | 10/1939 | Spiking | 182/155 |
| 2,573,740 | 11/1951 | Spiking | 182/155 |
| 2,704,688 | 6/1957 | Scott | 182/155 |
| 3,139,950 | 7/1964 | Bormann . | |
| 3,233,701 | 2/1966 | Hentzi | 182/155 |
| 3,269,487 | 8/1966 | Larson | 182/155 |
| 3,286,788 | 11/1966 | Swanson | 182/155 |
| 3,951,233 | 4/1976 | Meyers . | |
| 4,152,834 | 5/1979 | Stansberry | 182/155 |
| 4,489,808 | 12/1984 | Voye . | |
| 4,605,099 | 8/1986 | Crum et al. . | |
| 4,804,064 | 2/1989 | Coultrup et al. . | |
| 4,967,877 | 11/1990 | Wallman | 182/155 |

*Primary Examiner*—Reinaldo P. Machado

*Attorney, Agent, or Firm*—Murray E. Thrift; Stanley G. Ade; Adrian D. Battison

[57] ABSTRACT

A sawhorse has a T-shaped beam with two brackets secured to the beam adjacent its opposite ends. Legs are pivotally mounted on the brackets to pivot between extended positions projecting downwardly and sloping outwardly to the side and to the end of the beam and retracted positions lying along the underside of the top plate of the beam. The brackets are U-shaped sheet metal brackets that have support flanges at the top ends of their arms. The base of the bracket and the support flanges are connected to the vertical web of the main beam, while the top plate of the beam is also fastened to the support flanges. Locking arms are carried by the brackets to lock the legs in their extended positions and to brake movement of the arms between the extended and retracted positions.

13 Claims, 3 Drawing Sheets

FOLDING SAWHORSE

This application is a continuation-in-part of application Ser. No. 466,078, filed Jan. 16, 1990 now U.S. Pat. No. 4,967,877.

FIELD OF THE INVENTION

The present invention relates to sawhorse brackets and sawhorses using the brackets.

BACKGROUND

Co-pending application Ser. No. 466,078 relates to a sawhorse of the type comprising a T-shaped beam having a horizontal plate and a vertical web, two brackets secured to the beam adjacent opposite ends thereof, four legs and means pivotally mounting two legs on each of the brackets for movement of the legs between extended positions projecting downwardly from the rail and retracted positions alongside the web.

In the sawhorse of the prior application, each bracket comprises a substantially U-shaped base with upwardly convergent sides and support flanges projecting from upper edges of the sides. The base has a bottom panel secured at the centre thereof to a bottom edge of the web. The support flanges are engaged with and secured to the plate. Each bracket has leg stop flanges projecting outwardly from the sides, at an end of the bracket adjacent the end of the beam, for engaging the legs and supporting them in the extended positions. Locking means are provided for locking the legs in the extended and retracted positions.

According to the application, the locking means comprise two locking pins, pin mounting means mounting each pin for movement between a locking position projecting through a slot in a respective one of the base sides and a release position withdrawn from the slot, within the base, and resilient means for biasing the locking pin into the locking position.

The present invention is concerned with improvements in a bracket of the aforementioned type, and especially in the locking means.

SUMMARY

According to one aspect of the present invention there is provided a sawhorse bracket comprising:

a substantially U-shaped base with outer and inner ends, the base having upwardly convergent sides, support flanges projecting from upper edges of the sides, and leg stop flanges projecting outwardly from the sides, at the outer end of the base;

locking means comprising two leg engaging means, each with a locking face and a braking face substantially perpendicular thereto, mounting means mounting each leg engaging means for movement between a locking position with the locking face projecting outwardly from a respective side of the base, substantially parallel to the adjacent support flange and a release position with the locking face withdrawn substantially and the braking face facing outwardly substantially parallel to the adjacent side of the base, and resilient means for biasing the leg engaging means into the locking position.

The flat locking face acts on a relatively large area of the leg, so that wear of the leg is minimized. The braking surface acts to retain the leg in the retracted position by friction, so that opening the leg to the extended condition does not require manipulation of the lock.

The leg locking mechanism is manufactured simply as a single metal piece, not requiring additional assembly.

According to another aspect of the present invention there is provided a sawhorse according to Claim 10 including an elongate hand hole in the web.

BRIEF DESCRIPTION OF THE DRAWINGS

In the accompanying drawings which illustrate an exemplary embodiment of the present invention.

DETAILED DESCRIPTION

Figure 1:
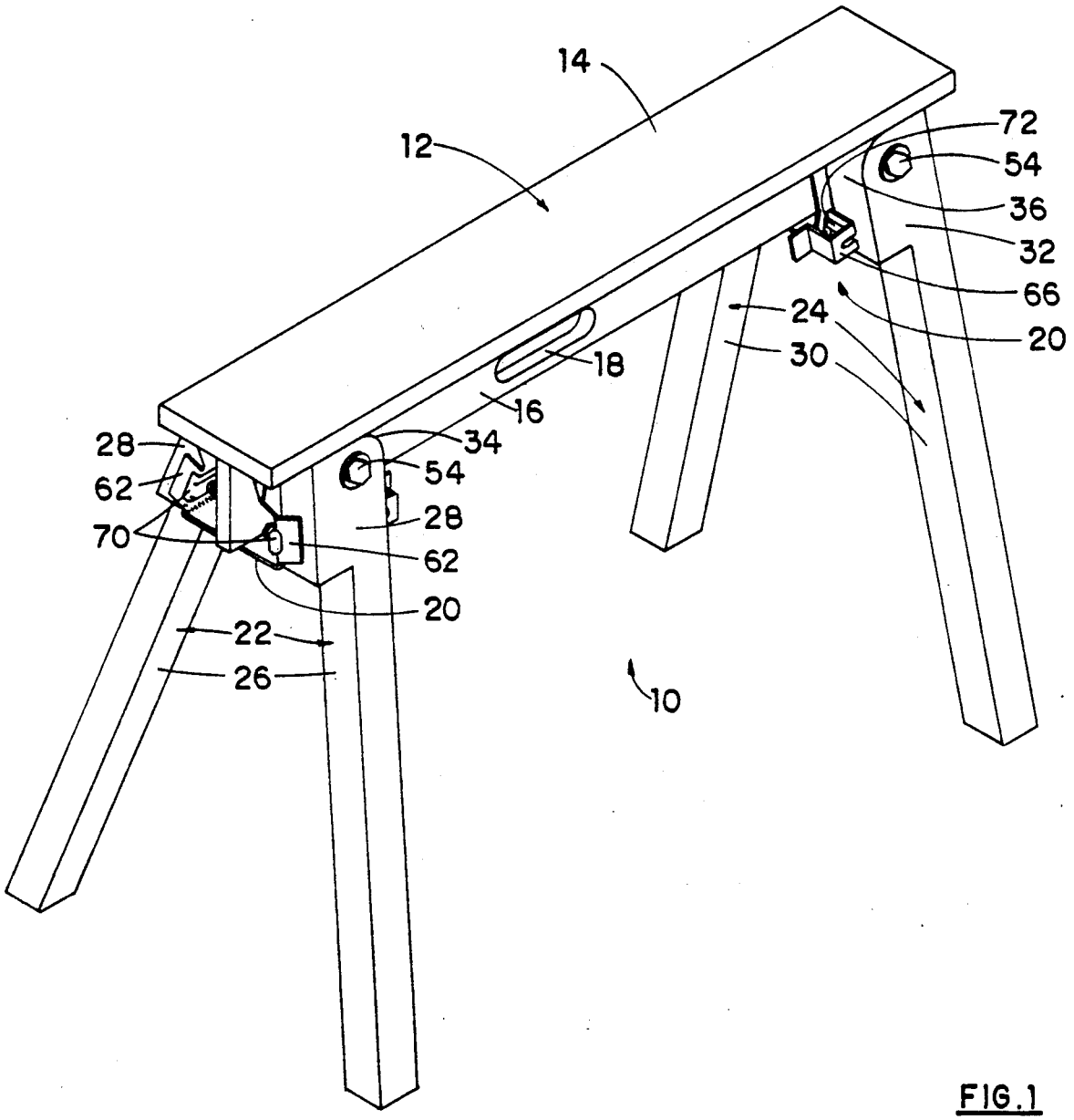
FIG. 1 is an isometric view of a sawhorse.

Referring to the accompanying drawings, and especially to FIG. 1, there is illustrated a sawhorse 10 with a T-shaped top beam 12. The beam includes a horizontal plate 14 and a vertical web 16 with its top edge mortised into the plate as shown most particularly in FIG. 4. An elongate hand hole 18 is formed through the web 16 so that the sawhorse can easily be carried in the inverted position when collapsed.

Figure 2:
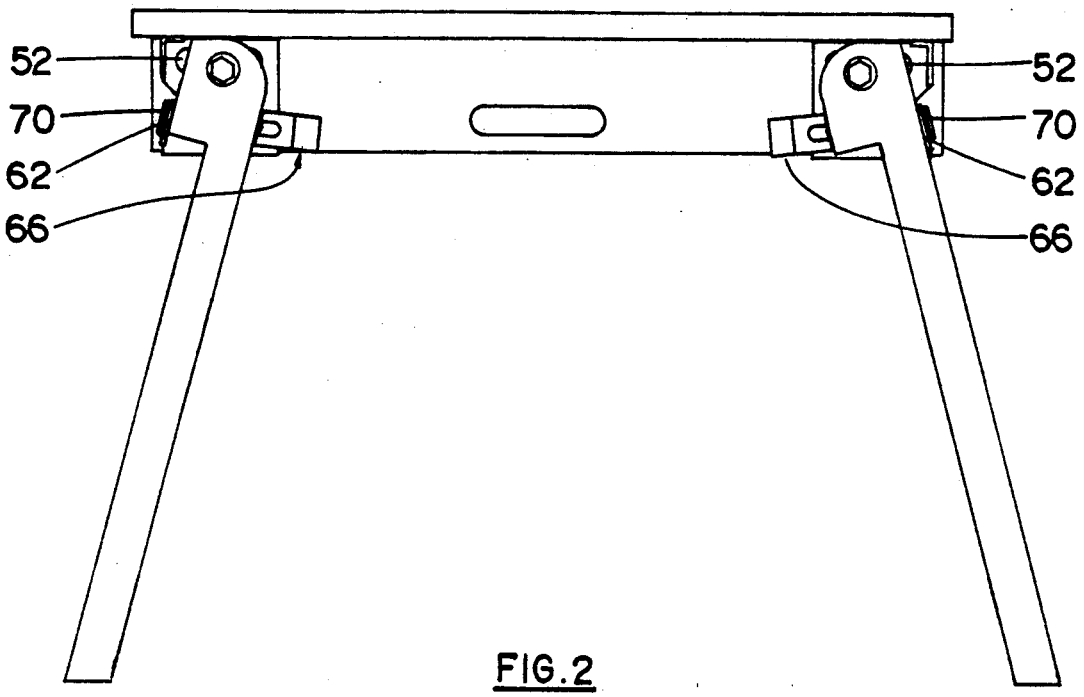
FIG. 2 is a side elevation of the sawhorse with the legs in the extended position.
Figure 3:
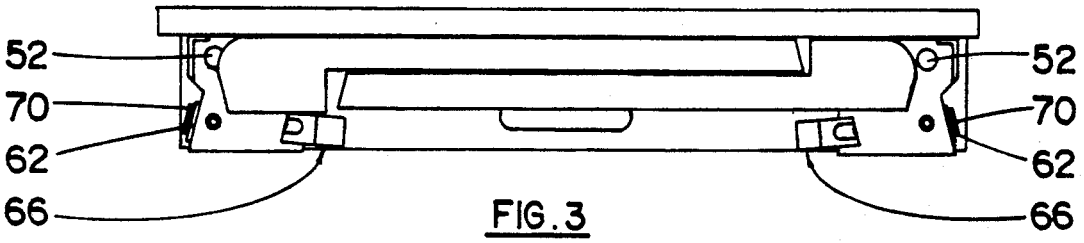
FIG. 3 is a side elevation of the sawhorse with the legs in the retracted position.

At either end of the beam 12 is a bracket 20. One of the brackets carries two legs 22 that extend down from the bracket and slope out both to the sides and to the ends of the beam. The other bracket carries two legs 24 that likewise slope out and to the end. Each of the legs 22 has a standard 26 and a head 28 that is offset from the standard towards the adjacent end of the beam 12. Each of the legs 24 has a standard 30 and a head 32 that is offset from the standard in a direction away from the adjacent end of the beam 12. As illustrated in FIGS. 1 and 2, the standards 26 and 30 on the same side of the beam 12 are offset with respect to their heads in the same direction. At the upper, inside corner of the leg 22, the leg is rounded at 34, while the upper, inside corner of each leg 24 is rounded at 36. As illustrated in FIG. 3, the legs 22 pivot upwardly from the extended position of FIG. 2 to the retracted position of FIG. 3, where the standard 26 lies on the underside of the plate 14. The leg 24 pivots upwardly in the opposite direction so that its standard 30 lies on the underside of the standard 26. This provides a compact nesting of the legs under the plate 14.

Figure 4:
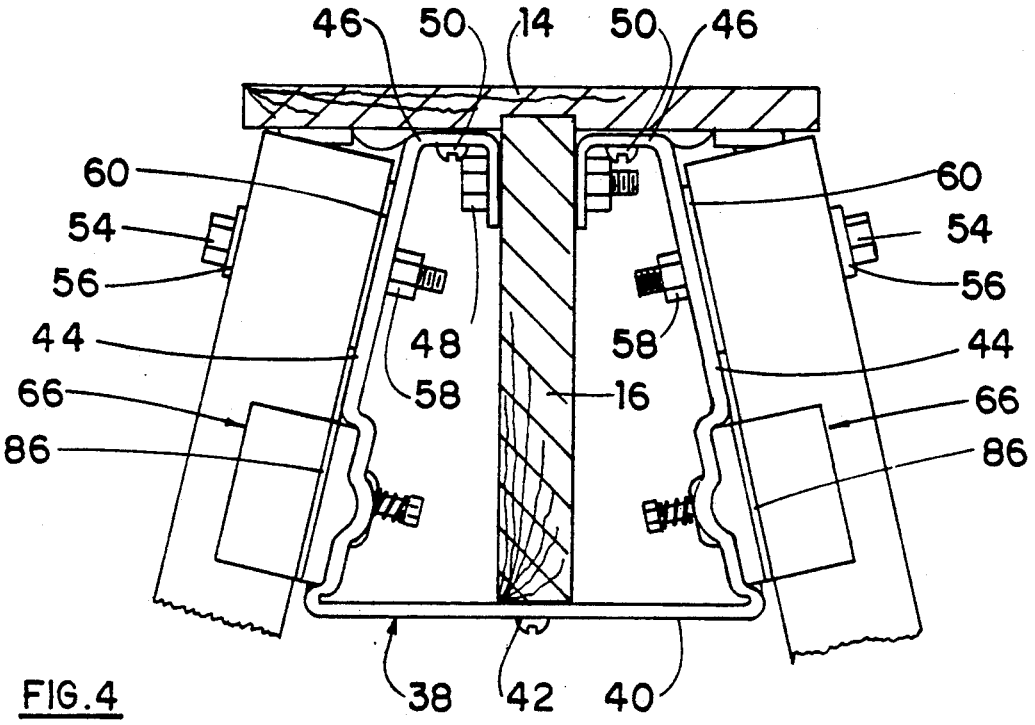
FIG. 4 is a partial elevation of the sawhorse along line 4—4 of FIG. 2.
Figure 5:
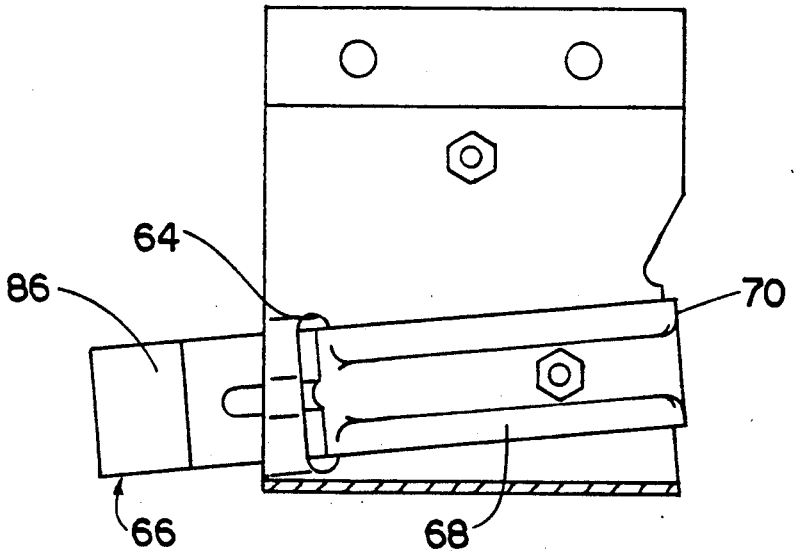
FIG. 5 is a view along line 5—5 of FIG. 4.

Each of the brackets 20 is made with a sheet metal base 38 of U-shape, as illustrated most particularly in FIG. 4. The base has a flat bottom panel 40 that is seated on the underside of the flange 14 and is secured to it by screws 42. The sides 44 of the base 38 are flat panels that slope upwardly and converge. Along the upper edge of each side is an inverted L-shaped support flange 46 that lies along the underside of the plate 14 and the side face of the flange 16. The support flange 46 is secured to the flange 16 of the beam 12 by two bolt and nut assemblies 48. It is secured to the underside of the plate 14 by screws 50. Bolt holes 52 (FIGS. 2 and 3) are formed in the sides 44 of the bracket base for access to the bolts 48.

Each of the legs is secured to one of the sides 44 of a bracket base with a bolt 54 extending through aligned holes in the leg and the side of the base. A washer 56 is fitted on the bolt under the head and a self-locking nut 58 is threaded onto the bolt on the interior of the bracket base. A large, nylon bearing washer 60 is fitted between the leg and the side 44 to prevent binding of the components.

Figure 6:
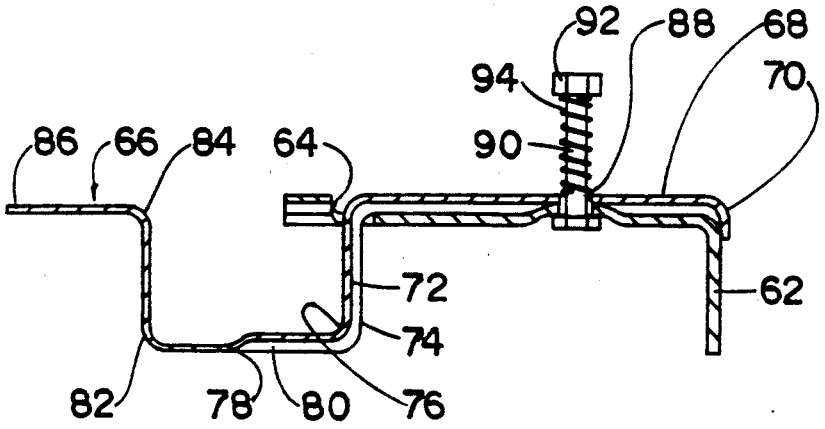
FIG. 6 is a view along line 6—6 of FIG. 5, and is found on the same sheet as FIGS. 2 and 3.

At the outer end of the bracket base, are two leg support flanges 62. These project out from the sides 44 and slope inwardly towards the top. They abut the faces of the legs to limit their pivotal movement to the extended condition as illustrated in FIGS. 1 and 2. Each side 44 of the bracket base has a through slot 64 parallel to the leg support flange 62 adjacent the inner end of the bracket base. Between the slot and the inner end of the bracket base, the side of the base is recessed as shown in FIGS. 4 and 6.

A lock plate 66 is associated with each side of the bracket base. The plate has a flat mounting arm 68 on the inside of the base side. A short flange 70 on the outside end of the arm 68 engages the outside of the support flange 62 to limit movement of the plate towards the inner end of the bracket. A right angle bend in the mounting arm 68 provides a leg engaging arm section 72 extending through the slot 64. This has an outside locking face 74 parallel to and confronting the inside face of the support flange 62 to engage the leg and lock it in the extended condition, as shown in FIG. 2. Beyond locking section 72, the plate 66 has another right angle bend 76 to provide a brake section 78 with a brake face 80 perpendicular to the lock by face 74. Two additional bends 82 and 84 provide an end tab 86 for the lockplate.

The mounting arm 68 is of the lock plate mounted on the interior of the associated side plate 44 with an aperture 88 fitted loosely onto a stud 90 on the side plate. A nut 92 is screwed onto the end of the stud 90 and a coil spring 94 is captured on the stud between the nut and the arm. This biases the arm against the interior face of the side plate 44. The loose fit of the aperture 88 on the stud 90 allows the arm to pivot inwardly to draw the arm section 72 through the slot 64, freeing the associated leg to pivot on its bolt 54. In the retracted condition of the leg, and between the retracted and extended conditions, the brake face 80 frictionally engages the inside face of the leg to prevent its free movement and to retain the leg in the retracted condition. To extend the leg, it is only necessary to pivot it to the extended position.

While one embodiment of the invention has been described in the foregoing, it is to be understood that other embodiments are possible within the scope of the present invention. The invention is to be considered limited solely by the scope of the appended Claims.

We claim:

1. A sawhorse bracket comprising:

a substantially U-shaped base with outer and inner ends, the base having upwardly convergent sides, support flanges projecting from upper edges of the sides, and leg stop flanges projecting outwardly from the sides, at the outer end of the base;

locking means comprising two leg engaging means, each with a locking face and a braking face substantially perpendicular thereto, mounting means mounting each leg engaging means for movement between a locking position with the locking face projecting outwardly from a respective side of the base, substantially parallel to the adjacent support flange and a release position with the locking face withdrawn substantially and the braking face facing outwardly substantially parallel to the adjacent side of the base, and resilient means for biasing the leg engaging means into the locking position.

2. A bracket according to claim 1 wherein each mounting means comprises an arm and means mounting the arm on a respective side of the base for pivotal movement towards and away from the side.

3. A bracket according to claim 2 wherein each mounting means further comprises a stud projecting from an internal face of a respective side of the base, an aperture in a respective one of the arms receiving the stud, the aperture being larger than the stud, and a nut on the stud, spaced from the associated side of the base.

4. A bracket according to claim 3 wherein the resilient means comprise a coil spring surrounding the stud and engaged between the arm and the nut.

5. A bracket according to claim 1 wherein the base comprises a substantially flat base panel and substantially flat side panels projecting upwardly therefrom.

6. A bracket according to claim 5 wherein the support flanges comprise inverted L-shaped flanges projecting towards one another from the upper edges of the sides of the base.

7. A bracket according to claim 2 wherein the leg engaging means comprise a section of the arm projecting outwardly from the arm.

8. A bracket according to claim 7 wherein each arm comprises a plate and the leg engaging means comprise sections of the plate defined between right angle bands on the plate.

9. A bracket according to claim 8 including a slot in each side of the bracket and wherein the leg engaging means extend through the slots.

10. A sawhorse comprising a T-shaped beam having a horizontal plate and a vertical web, two brackets secured to the beam adjacent opposite ends thereof, four legs and means pivotally mounting two legs on each of the brackets for movement of the legs between extended positions projecting downwardly from the beam and retracted positions lying alongside the web, each bracket comprising a substantially U-shaped base with upwardly convergent sides and support flanges projecting from upper edges of the sides, the base having a bottom panel secured at the centre thereof to a bottom edge of the web, the support flanges being engaged with and secured to the plate, each bracket having leg stop flanges projecting outwardly from the sides, at an end of the bracket adjacent the end of the beam, for engaging the legs and supporting them in the extended positions, locking means for locking the legs in the extended positions and brake means for restraining movement of the of the legs between the extended and retracted positions.

11. A sawhorse according to claim 10 including an elongate hand hole in the web.

12. A sawhorse according to claim 10 wherein the legs slope outwardly to the sides and to the ends of the beam in the extended positions.

13. A sawhorse according to claim 12 wherein each leg comprises a standard portion and a head portion, the head portion being pivotally mounted on the associated bracket at a position offset from the standard portion, the legs on each side of the beam having the standards offset with respect to the respective pivots in the same direction along the beam.

* * * * *